United States Patent [19]

Montemayor

[11] 3,970,313

[45] July 20, 1976

[54] ANCESTRAL EDUCATIONAL GAME APPARATUS

[76] Inventor: Ernest A. Montemayor, 4600 45th St. NW., Washington, D.C. 20016

[22] Filed: Oct. 31, 1974

[21] Appl. No.: 519,691

[52] U.S. Cl. ..... 273/134 AD; 273/134 B; 273/134 C; 273/134 D; 273/134 AT

[51] Int. Cl.[2] ..... A63F 3/00

[58] Field of Search ..... 273/134

[56] References Cited

FOREIGN PATENTS OR APPLICATIONS 1,120,642 7/1968 United Kingdom ..... 273/134 C

*Primary Examiner*—Delbert B. Lowe

*Attorney, Agent, or Firm*—John E. Becker

[57] ABSTRACT

An educational and recreational game for teaching players the engaging and appealing hobby or vocation of genealogy with an object to inspire players subsequently to trace their own real-life ancestors and to preserve a record of their family lineage for posterity. The game includes a multi-sided playing board having a continuous peripheral course divided into a pluality of interconnected playing spaces. Additional game apparatus includes a family tree of genealogy chart with slotted and color-coded stepped lines on which to record family ancestors; player pieces of different color and/or form; a set of male and female "Ancestor" cards playable from dual trays and adapted for particular placement in the appropriate slotted lines of the chart to be arranged in a predetermined manner to try to complete a player's chart; a set of "Grandmother's Attic" cards also preferably playable from a dual tray, which cards have instruction indicia thereon to help direct play of the playing pieces as well as of the "Ancestor" cards; and a chance controlled device to determine the number of spaces a player moves his piece around the peripheral course. The spaces have varied indicia some of which further direct the play of the game responsive to a player landing thereon. The game object is for each player to try to complete his family tree or genealogy chart before the others, from the fictitious ancestors named on the male and female "Ancestor" cards; said cards bearing certain vital statistics of the ancestor. The chart and "Ancestor" cards further have correlative indicia to facilitate correct correlating of the "Ancestor" cards with the slotted lines of the genealogy chart.

20 Claims, 11 Drawing Figures

FIG. 1.
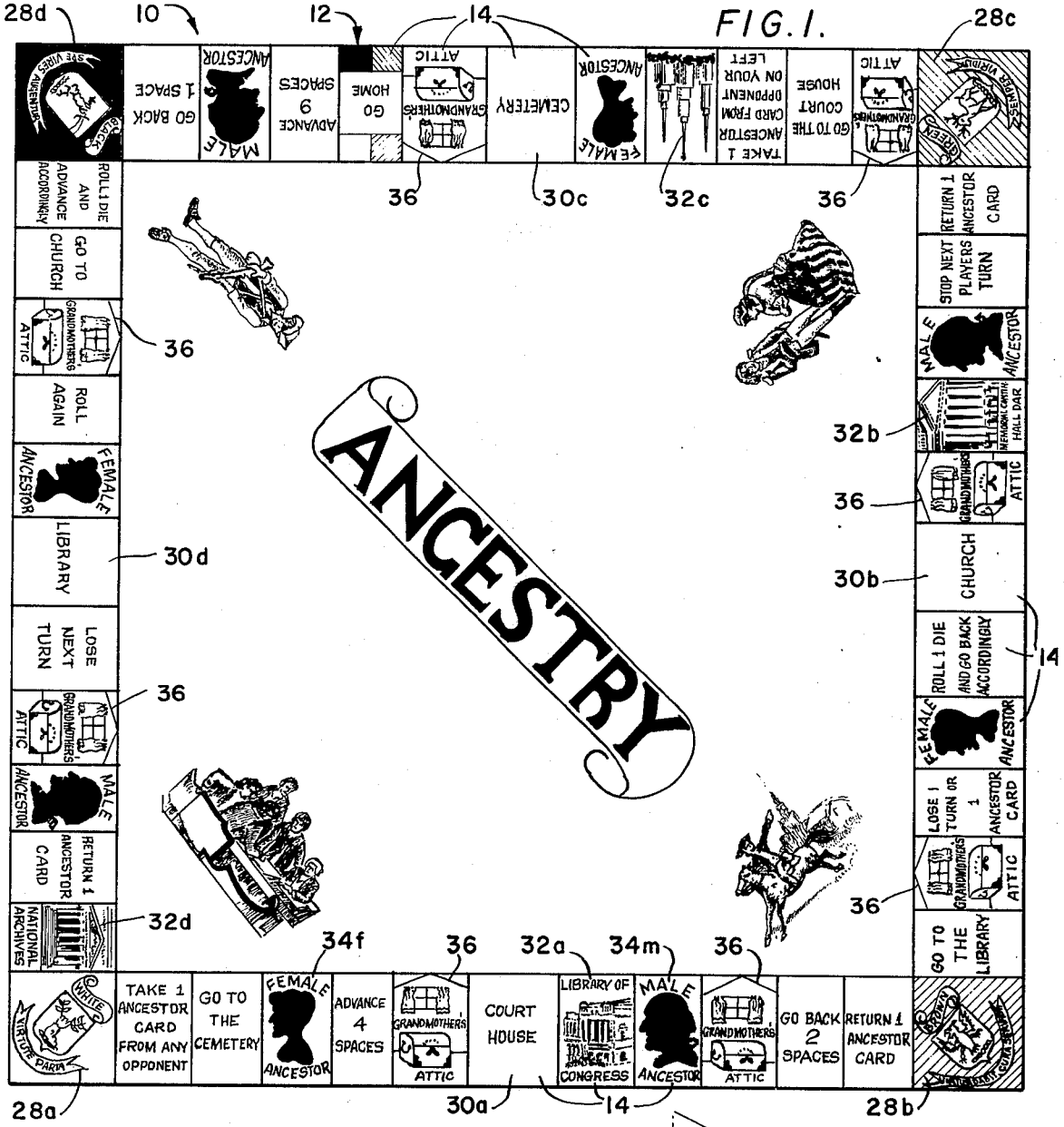
FIG. 2.
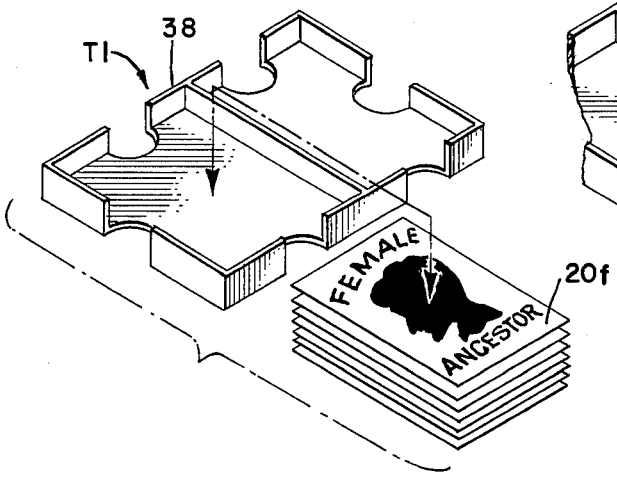
FIG. 2A.
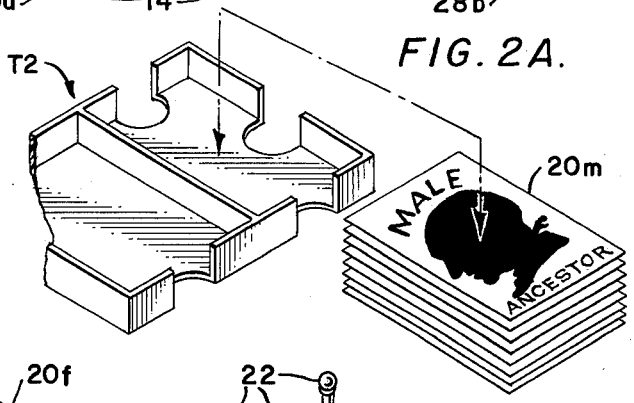
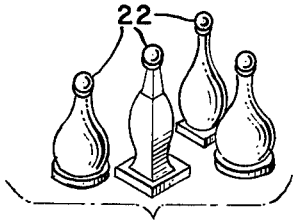
FIG. 3.

FIG. 5.
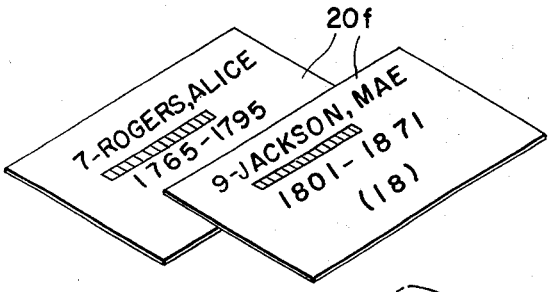
FIG. 6.
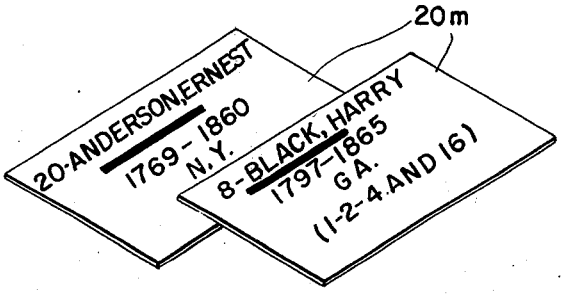
FIG. 7.
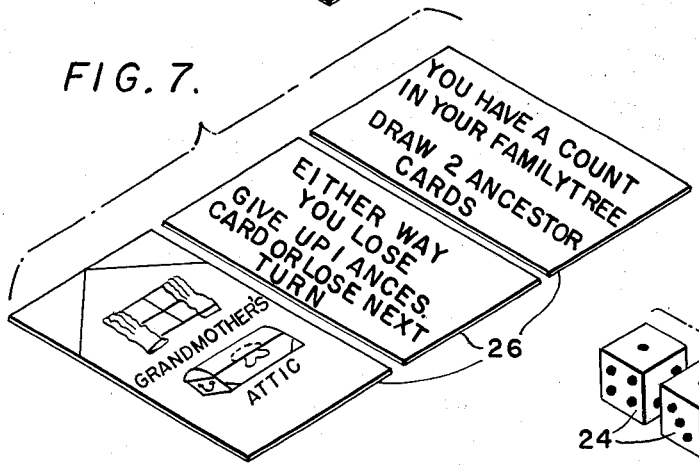
FIG. 8.
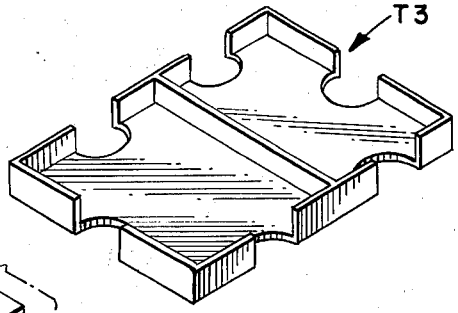
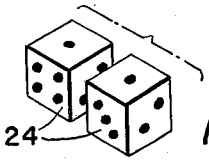
FIG. 4.
FIG. 9.
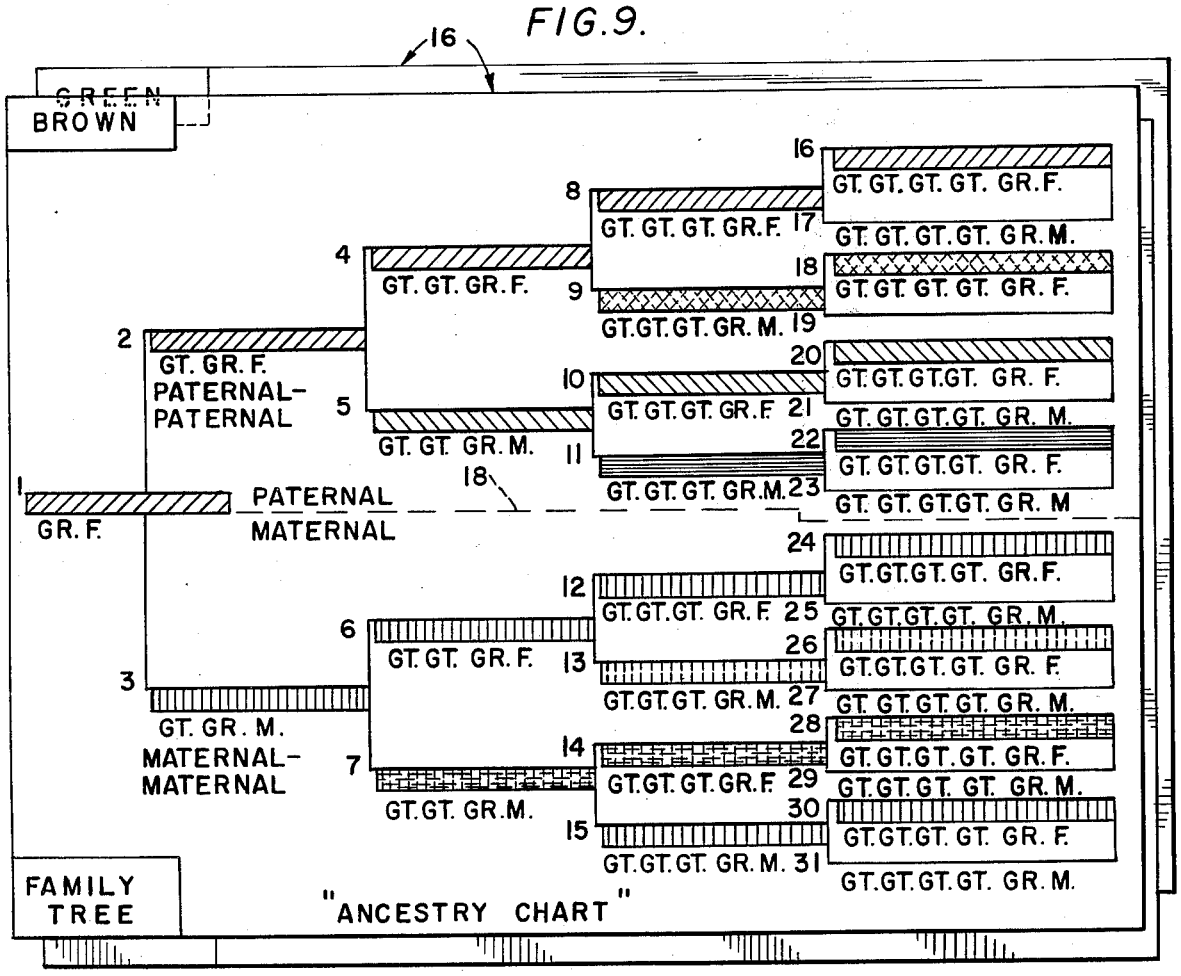

ANCESTRAL EDUCATIONAL GAME APPARATUS

BACKGROUND OF THE INVENTION

This invention is directed to combined recreational and educational game apparatus related to the unique subject matter of genealogy.

Heretofore there has been considerable writing on the subject by a variety of authors either because of, or serving to help generate, a growing desire of people to learn more about their family lineage. However, there have been no known educational type games directed to the subject, or any similarly oriented game apparatus of which I am aware. Among the very limited prior U.S. patent art, none of which even remotely approaches the present invention in apparatus content and function, are U.S. Pat. Nos. 432,148 and 1,058,859. Both relate to non-analogous types of pedigree charts per se, the former being of stick-connected name plates intended essentially for recording animal pedigrees, while the latter is directed to a chart foldable compactly into generally triangular quandrants, intended primarily for recording human family tree lineage.

OBJECTS AND BRIEF SUMMARY OF THE INVENTION

The primary object of the present invention is to both stimulate an interest in genealogy and to teach the manner of completing a genealogical chart in an interesting and enjoyable manner leading to the cultivation of a fascinating hobby.

With the continuing increase in the popularity of board games, and attendant increased leisure time in family lives, together with a desire to do things as a family, and the increasing quest for identity and a growing preoccupation with the past turning toward genealogy, there is a need and place for an educational game in compliance with the object of the invention hereof.

A further object is to provide an educational game of the foregoing character which is appealing not only to more mature middle age and older persons, but also to youthful students.

Still another object is to provide an educational/recreational game of the foregoing character which can provide inexpensive and fascinating therapeutic pastime for people of all ages who may otherwise be relegated to spening much time alone, particularly when interest in other hobbies tends to wane.

The objectives of the present invention are achievable with game apparatus comprising preferably a square or other polygonal shaped playing board having a continuous peripheral playing course of serially adjoining segmental spaces. Additional game apparatus includes a family tree or genealogy chart with slotted and color-coded stepped lines on which to record family ancestors; player pieces of different color and/or form; a set of male and female "Ancestor" cards playable from dual trays and adapted for particular placement in the appropriate slotted lines of the chart to be arranged in a predetermined manner to try to complete the player's chart; a set of "Grandmother's Attic" cards also preferably playable from a dual tray, which cards have instruction indicia thereon to help direct play of the playing pieces as well as of the "Ancestor" cards; and chance controlled means such as dice or a spinner on a numbered disc to determine the number of spaces a player moves his piece around the peripheral course. The spaces have varied indicia some of which further direct the play of the game responsive to a player landing thereon. The game object is for each player to try to complete his family tree or genealogy chart before the others, from the fictitious ancestors named on the male and female "Ancestor" cards; said cards bearing certain vital statistics of the ancestor. The chart and "Ancestor" cards further have correlative indicia to facilitate correct correlating of the "Ancestor" cards with the slotted lines of the genealogy chart. This is done by the players each collecting "Ancestor" cards with the same principal or surname as that being used by the player, together with other name "Ancestor" cards chosen to fit into the family tree by inserting the various cards in the appropriate slots on the family tree chart until completed.

The game is designed to be played by two, three or four players to acquaint them with, and cultivate their interest in, the subject of genealogy as a hobby, and is playable in a general manner not completely unlike the popular game of "MONOPOLY" described in U.S. Pat. No. 2,026,082.

The foregoing and other objects will become more readily apparent from the following detailed descripiton taken in conjunction with the accompanying illustrative drawings.

BRIEF DESCRIPTION OF DRAWINGS

FIG. 1 is a top plan view of the playing face of a game board in accordance with the present invention;

FIGS. 2 and 2A are perspective views of two sets of "Ancestor" cards, male and female, and dual card-holding trays;

FIG. 3 is a perspective view of suitable playing pieces for the game;

FIG. 4 is a perspective view of dice usable in playing the game of the present invention;

FIG. 5 is a perspective view showing the faces of two exemplary female ancestor or ancestry cards on an enlarged scale;

FIG. 6 is a perspective view like FIG. 5 but showing two exemplary male ancestor cards;

FIG. 7 is a perspective view showing both the back and faces of two of the "Grandmother's Attic" cards usable in playing the game;

FIG. 8 is a perspective view of a dual card holding tray for use with the "Grandmother's Attic" cards depicted in FIG. 7;

FIG. 9 is a plan face view of a family tree or genealogy chart having color-coded name-card-receiving slots to receive the cards representing various family and ancestral members.

DETAILED DESCRIPTION OF A PREFERRED EMBODIMENT

Figure 10:
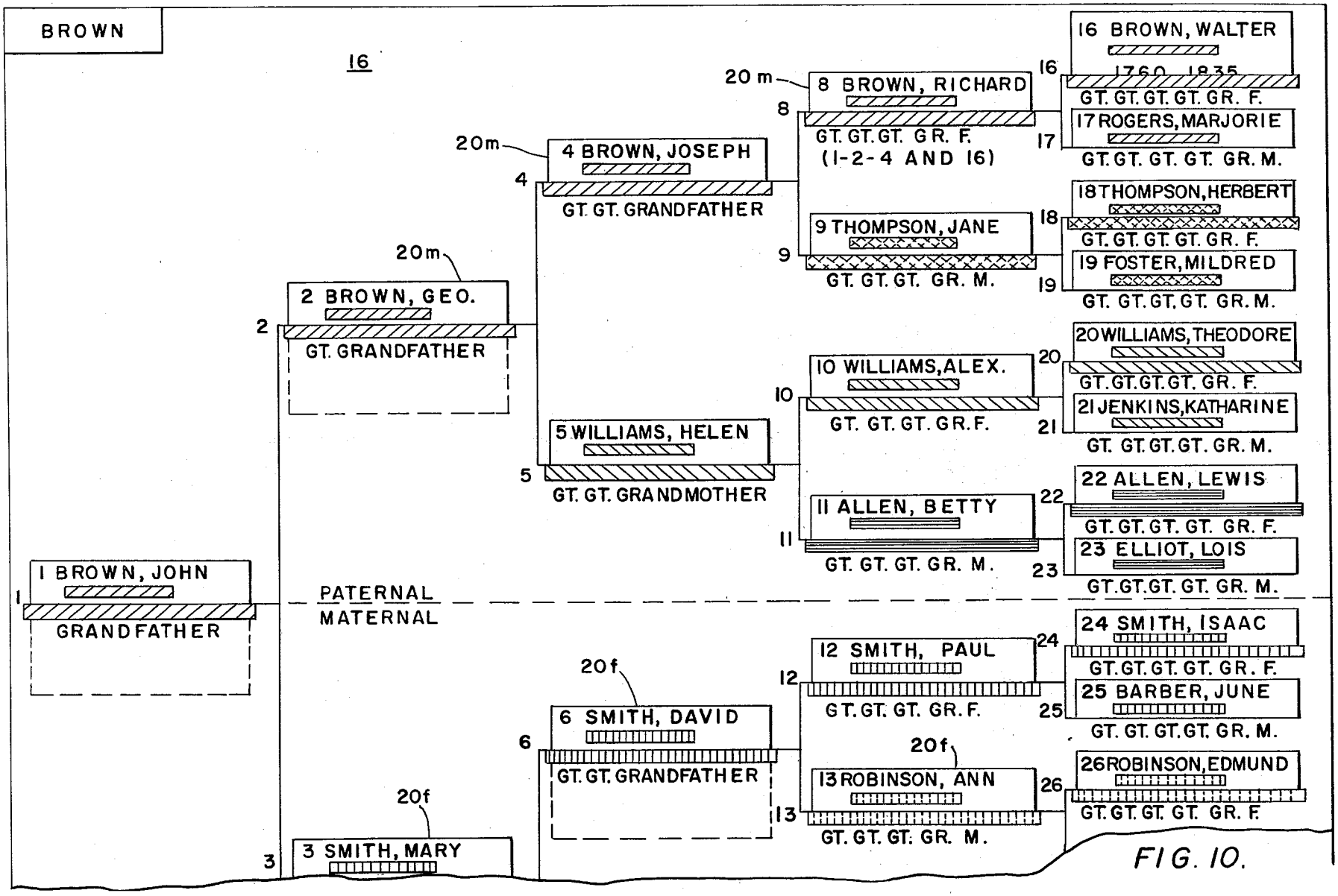
FIG. 10 is an enlarged fragmentary plan view of the family tree chart of FIG. 9, showing several of the ancestry cards in the slots thereof.

The detailed description will be made with reference to the illustrative drawings wherein like reference numerals represent like parts throughout the several figures.

As seen in FIG. 1, the playing board is preferably of planar square form generally designated 10 in its entirety, and is provided with a continuous peripheral playing course 12. Course 12 is comprised of a plurality of interconnected playing spaces or segments 14, each of which is provided with distinctive lettering and/or design indicia affecting the play of the game when a player's piece lands thereon.

Certain of the segments may be repeated along each of the four sides. The various segments will be described in greater detail hereinafter.

Additonal playing parts include for each player a genealogy chart 16 shown in FIGS. 9 and 10 which is a modified form of a generally conventional type chart. Charts 16 may include a conventionally known arrangement of the plural horizontal lines interconnected in a series of ascending and inverted descending steps and which normally are adapted to receive names of successively preceding generation ancestors in a retrogressive manner.

The charts 16 used in the present embodiment have the horizontal lines cut thru to provide slots or pockets for each line. The slotted lines are further provided with a superposed or adjacent strip of color used to color code the slots in a predetermined ascending order for various parts. Each chart 16 is preferably provided with a horizontal medial dotted line 18 to divide it into upper and lower sections, the upper of which is for recording the player's grandfather's paternal ancestors, while the lower is for recording the player's grandfather's maternal ancestors. The portions are appropriately labeled.

The first line or slot, numbered 1 on the chart, is positioned substantially on the center line and commences at the left hand side of the chart, as shown. While the charts may vary in overall size, a practical size has been found to be approximately 11 inches × 15 inches, having a total of five vertical series of slotted lines representing five different generations. Within this framework and an arbitrarily selected time period in history, by arbitrarily having the first slot numbered 1 (FIGS. 9 and 10) represent a place for a player's hypothetical grandfather, the remaining four exemplary vertical series of slotted lines can represent successively preceding hypothetical generations normally capable of carrying back to the 1700's (18th century) which is generally sufficient to trace the North American ancestry of the player.

As mentioned hereinbefore, and to be described in detail hereinafter, the slots now being described are adapted to receive various male and female "Ancestor" cards generally designated 20. The male cards are designated 20*m* (FIGS. 2A, 6& 10) and the female cards are designated 20*f* (FIGS. 2, 5 and 10).

Continuing with slots designated 2 and 3, slot 2 represents the slot for the card of the grandfather's father, and slot 3 represents that for the grandfather's mother. Each such slot divides in stepped fashion into two more slots, until the predetermined number of generations has been provided for on the chart. Proceeding from slot number 1, the ascending even numbered slots, for example 2, 4, 8 and 16 all represent slots for cards of male ancestors of the grandfather. In fact, in the present chart, all even numbered slots represent slots for male ancestor cards, whereas all odd numbered slots represent slots to receive female cards.

On the illustrative chart 16, there are slots numbered 1 thru 31 adapted to receive the correspondingly numbered "Ancestor" cards 20, each of which represents a separate hypothetical ancestor of the player.

It is to be noted that the player's grandfather's father, number 2, is twice the number of the grandfather, number 1, and his mother's number 3 is twice the number plus one. Throughout the board, every father's number is twice the number of his child and every mother's number is her husband's number plus one. Picking any number from the chart one should be able to tell the relationship; e.g., 15 is the wife of 14 and they are the parents of 7. Similarly, 21 is the wife of 20 and they are the parents of 10, who with his wife number 11 are the parents of 5, who with her husband number 4 are the parents of 2. In turn, 2 with his wife number 3, are the parents of 1.

Continuing with the description of the playing parts, in addition to the board 10, genealogy charts 16, and "Ancestor" cards 20, there are the four differently colored playing pieces 22 shown in FIG. 3, and the dice 24 in FIG. 4, which represent chance-controlled means for determining the number of segments or spaces a player moves his playing piece during play of the game. The last major component is the deck of "Grandmothers Attic" cards 26 illustrated in part in FIG. 7. The "Ancestor" cards 20, hereinafter designatable as A cards, and the "Grandmother's Attic" cards 26, hereinafter designatable as GA cards, each are preferably provided with card-holding trays T1, T2 and T3, respectively, shown in FIGS. 2, 2A and 8.

The resepective playing parts or components will be described now in greater detail, starting with the playing board 10. The peripheral playing course 12 includes four distinctive corner combined starting and home segments 28*a*, 28*b*, 28*c* and 28*d*, each of which contains preferably a combination of artistic and word indicia indentifying a different player's hypothetical name. For example, playing segment 28*a* contains a coat-of-arms design and the family name "White", upon which segment the player with the "White" color playing piece will start his play. Similarly, segments 28*b*, 28*c* and 28*d* respectively bear other coats-of-arms and the hypothetical family names Brown, Green and Black. The various hypothetical but quite common family names have been arbitrarily chosen in order to correlate names to colors, thereby facilitating appropriate corresponding color coding of the various playing pieces 22, portions of the playing course, slot portions of the genealogy charts 16, and portions of the A cards 20. For example, as an aid, those slots requiring the same last name contain an identical color line on the chart. Additionally, the names on the "Ancestors" cards are similarly underlined in color and have before the name the number of the slot to which they correspond, and elsewhere, in parentheses, the numbers of other related slots.

Other segments 14 of the playing course 12 include either pictorial and/or word indicia representative of instructions for the players to follow as they advance their pieces in response to the number thrown on the dice 24.

Preferably each side of the playing board has a center segment 30*a*, 30*b*, 30*c* and 30*d*, each bearing different word indicia representative of real life research places for tracing family ancestors. For example, segment 30*a* contains the legend or words COURT HOUSE; segment 30*b* has the word CHURCH; segment 30*c* has the word CEMETERY and segment 30*d* has the word LIBRARY. The use of these during the play will be discussed hereinafter.

Still additional arbitrarily chosen segments along each side of the peripheral playing course are provided with other pictorial and word representations of still other research places, such as 32*a* denoting the LIBRARY OF CONGRESS; 32*b* the D.A.R. Hall; 32*c* a national temple or cathedral, such as one of the Mormon Temples; and 32*d* the NATIONAL ARCHIVES, all of which are preferably included as a tribute to the importance they contribute to genealogical research.

Further of the course segments, preferably two on each side of the board, are provided with both word indicia, GRANDMOTHER'S ATTIC, and pictorial indicia depicting an old storage trunk and typical attic scenery such as a curtained window in a gable end of the attic. These segments are denoted 36 in FIG. 1 along all sides.

Dispensing of the "Ancestor" or A cards 20*f* and 20*m* during game play is regulated in part by the inclusion of both MALE and FEMALE ANCESTOR segments 34*m* and 34*f* respectively at arbitrarily spaced locations on each respective side of the playing board. These segments or spaces are interspersed among the previously described segmented spaces and still other spaces containing such legend indicia as: TAKE 1 ANCESTOR CARD FROM OPPONENT; GO TO CEMETERY; ADVANCE 4 SPACES; GO BACK 2 SPACES; RETURN 1 ANCESTOR CARD; GO TO LIBRARY; LOSE 1 TURN or 1 ANCESTOR CARD; ROLL 1 DIE & GO BACK ACCORDINGLY; STOP,-NEXT PLAYER'S TURN; RETURN 1 ANCESTOR CARD; GO TO COURT HOUSE; TAKE ONE ANCESTOR CARD FROM OPPONENT ON LEFT; GO HOME; ADVANCE 9 SPACES; and GO BACK 1 SPACE.

The various segments or spaces may be of either uniform or arbitrarily differently colored background. The name of the game, such as "ANCESTRY", is preferably artistically imposed across the center of the game board, and optionally surrounded by other appropriate design indicia depicting ancestral/historical occurrences to futher artistically embellish the playing board.

The "Ancestor" cards 20*m* and 20*f* preferably have an early American vintage silhouette of a male and female bust respectively on the back of the cards. On the face of the cards, each of the male cards 20*m* contains the name and other statistical data of a male ancestor programmed to fill one of the corresponding male ancestor slots provided in the charts 16.

FIGS. 5 and 6 are representative of two such female and male ancestor cards 20*f* and 20*m*, respectively. In addition to the name, the cards include before each name the number of the chart slot in which the card is to be inserted in play; and beneath the name is a color code strip, plus the birth and death year dates, and the state where he lived. Then in parentheses therebeneath is the number or numbers of other chart slots with which the card is to be associated when played. As mentioned earlier in this specification, the color coding strip beneath the names of certain groups of the cards are supplemental visual aids for correlating certain of the cards with certain of the similarly color-coded slots in the genealogy charts 16.

FIG. 10 is an example of a chart whose numbered and color-coded slots are filled with appropriately correspondingly numbered and color-coded male and female ancestor cards 20.

Amplifying the description of the deck of Grandmother's Attic cards 26, the backs of the cards, as shown clearly in the left hand portion of FIG. 7, are artistically embellished with the same design and word indicia as that used on the correspondingly designated playing course segments 36. The fronts of the cards 26 bear instruction indicia which must be followed by the player drawing such a card in response to his playing piece having by chance landed upon one of the Grandmother's Attic spaces or segments 36. Examples of the instruction indicia are shown on the two cards in the center and right hand portions of FIG. 7.

The object of the game is for each player to be first in completing his genealogy chart from name/slot No. 1 thru name/slot No. 31 in a manner correctly completing or tracing his ancestors for five generations.

To be correct the chart must contain the Ancestor cards with the principal name of the player (BROWN, WHITE, GREEN, or BLACK) in the chart slots numbered 1, 2, 4, 8 and 16. Similarly, the rest of the color-coded ascending groupings must respectively contain only one last name in the chart slots at completion. Examples of the various choices are shown below opposite the grouping of numbers to which they can be correlated on the chart 16.

| Groups: | Must contain one of the following names: |
|---|---|
| 3, 6, 12, & 24 | JONES, SMITH, JOHNSON, or MILLER |
| 5, 10, & 20 | WILLIAMS, DAVIS, ANDERSON, or WILSON |
| 7, 14, & 28 | TAYLOR, THOMAS, MOORE, or MARTIN |
| 9 & 18 | THOMPSON, JACKSON, HARRIS, or LEWIS |
| 11 & 22 | ALLEN, NELSON, WALKER, OR HALL |
| 13 & 26 | ROBINSON, ADAMS, BAKER, or KING |
| 15 & 30 | ROBERTS, PHILLIPS, EVANS, or TURNER |

In the last row of the chart, slots numbered 17, 19, 21, 23, 25, 27, 29, and 31, (all female ancestors) may contain "Ancestor" cards of any last name as long as the "Ancestor" card number matches the space or contains no number. Cards with no numbers are extra and may be used in place of odd numbers 17, 19, 21, etc., above. As an aid, these slots requiring the same last name contain an identical color line on the chart. Additionally, the names on the "Ancestor" cards are similarly color coded as stated hereinabove, and preferably contain in parentheses the slot numbers to which they correspond.

GAME PLAY PREPARATION AND OPERATION

The game may be played by two, three or four players. The board 10, which may be made to fold at least in half, is placed upon a playing table or surface. The GRANDMOTHER'S ATTIC cards are shuffled and placed face down in one side of the double tray T3 (FIG. 8). The Ancestor cards are separated into decks of male and female cards, shuffled separately and placed face down on their respective earlier mentioned dual trays T1 and T2 (FIGS. 2 and 2A).

Each player selects a playing piece 22, each of which is of one of the different selected colors BROWN, WHITE, GREEN, and BLACK. These colors are also representative of the basic ancestral names for each of the groups of numbered slots 1, 2, 4, 8 and 16 in charts 16. Each player places his piece on his "Ancestral Home" color square on one of the corners of the playing board. The players familiarize themselves with the charts 16. As mentioned before, starting with the player's hypothetical grandfather, relative to the slotted chart 16, slot number 1 represents the latest generation; slots 2 and 3 the next preceding generation; slots 4, 5, 6 and 7 the next preceding generation, etc.

To commence the play, each player initially draws four Ancestor cards 20, two each from the male and female trays T1 and T2. Each of the cards is placed in the corresponding slot of his chart. If any of these cards has a principal name other than that of the player's selected basic family name, the card is returned to the tray face up and another card is drawn in its place.

To determine which player starts the play, the dice are thrown and the player with the highest combined total throws the dice again and moves his player piece clockwise (left to right) the number of spaces indicated by the total of the dice. He follows the instructions indicated by the space he reaches. He may be obliged to draw an ANCESTOR card, or a GRANDMOTHER'S ATTIC card which may instruct him to roll again; lose next turn; etc. Other players follow in turn, clockwise. A throw of the dice of two ones or two sixes entitles a player to an extra turn. Two or more player pieces may rest on the same space at the same time.

Each time a player passes his "Ancestral Home", 28*a*, 28*b*, etc., he draws one ANCESTOR card. If he lands one, or is sent to, his home he draws two ANCESTOR cards. When a player lands on an opponent's "Ancestral Home" he gives the opponent one ANCESTOR card. If less than four players are playing, and a player lands on an "Ancestral Home" not in play, he is "just visiting."

Each time a player lands on either a male or female ancestor space, he takes the top two cards from either the male or female tray, as indicated by the board, and inserts them in the appropriate numbered slots on his chart. If a slot is occupied, he may replace the card in the slot, returning whichever one is not used, face up, to the opposite side of the corresponding male or female tray. If a player lands on a male or female Ancestor space on the board and no cards remain on the tray, he waits for his next dice roll for another opportunity to continue to play. Reshuffle of the cards occurs when about half of the cards are used, or when desired by any player.

Each time a player lands on a GRANDMOTHER'S ATTIC space, he takes the top card from the deck; follows the instructions on the card; and returns the card, face up, to the opposite side of the tray. Reshuffle of the cards may occur as desired.

When a player lands on or is sent to CHURCH, either by a space on the board or by a GRANDMOTHER'S ATTIC card, he lets each opponent draw one ANCESTOR card. If he lands in CHURCH during the course of play, there is no penalty.

Each time a player lands on, or is sent to, the LIBRARY space, he draws one ANCESTOR card and one GRANDMOTHER'S ATTIC card.

When a player lands on, or is sent to, the COURT HOUSE, he takes one ANCESTOR card from each opponent or draws two ANCESTOR cards.

Each time a player lands in the CEMETERY he loses his next turn. If he is sent to the CEMETERY either by a board space or a GRANDMOTHER'S ATTIC card, he loses two turns. He may, however, not lose his turn if he has a GRANDMOTHER'S ATTIC "LEAVE CEMETERY" card, or returns to the pile one ANCESTOR card if he simply lands thereon, or he returns two ANCESTOR cards if he has been sent to the CEMETERY. The LEAVE CEMETERY cards, which comprise part of the GRANDMOTHER'S ATTIC deck of cards, are returned to the opposite side of the tray T3 face up, when used.

Whenever a player lands upon a space marked GO TO . . , he is not entitled to draw an ANCESTOR card if he passes his "Ancestral Home" on the way. An exception, of course, is if he is sent to his "Ancestral Home", which is his original starting point.

Relative to the other spaces, the players follow whatever instruction is included thereon. No special play action is required when landing upon spaces containing the special pictorial indicia of the National Archives, Library of Congress, D.A.R. Hall, and Mormon Temple or the like.

All names used in the game/educational device hereof are fictitious and any similarity to persons living or dead is purely coincidental.

Selection of one name is as good as any other as far as chances of winning are concerned. Deciding whether to draw a male or female ANCESTOR card when it is optional depends on the needs of the player at the time of the play.

The Crests and Mottoes to be preferably used on the board and charts may be selected from Fairbairn's Crests of the Families of Great Britain and Ireland, First Edition, 1968. their description and translation is as follows:

BROWN; John, Esq., of Clonboy, County Clare. An eagle displaced. "Virtus dabit, cura servabit." (Virtue shall give, care shall preserve.)

WHITE; William Logan, Esq., of Kellerstain (Mid-Lothian). An arm, supporting a garland of laurel. "Virtute parta." (Produced by Virtue.)

GREEN; Thomas Abbott, Esq., of Pavenham Bury, Bedfordshire. A buck, trippant (Gold). "Semper Virides." (Always flourishing.)

BLACK; (of) London. An arm, in armour, embowed, in hand a scimitar (Argent). "Spe Vires Augentur." (Strength is increased by hope.)

Further specific rules of play will now be described.

Each time a player draws, takes, or receives an ANCESTOR card he must use it in the appropriate slot number on his chart or return it face up to the opposite side of the corresponding male or female tray. He may not draw another card to replace a duplicate card which he returns to the tray. He may, however, use an ANCESTOR card, regardless of the last name, except principal names, in an appropriate numbered slot until he decides the last name he wants to follow to completion, reserving the right to switch names at any time until completion.

When drawing an ANCESTOR card with a principal last name of an opponent or a principal last name not in play (BROWN, WHITE, GREEN, or BLACK), he returns it to the appropriate tray (opposite side), face up, and draws again.

Players told to take an ANCESTOR card from an opponent cannot take a principal name card of the opponent (1, 2, 4, 8, or 16), nor one that matches with one or more corresponding cards of the same last name on his opponent's chart. Similarly, players told to give an ANCESTOR card to an opponent or return one to the pile must not give up one that is of his principal name nor one that corresponds to one or more cards on his chart with the same last name.

"Draw" and "return" always relate to action with the pile, either of ANCESTOR cards of GRANDMOTHER'S ATTIC cards, while "give" and "take" relate to action between opponents.

Except when landing on a male or female Ancestor space, a player may "draw", "give", "take", or "return" either a male or female ANCESTOR card at his option as long as it conforms with stated rules above.

As a BONUS, whenever any player completes slots 2 and 3 on his chart he draws one extra ANCESTOR card; when he completes slots 4, 5, 6, & 7 he draws two extra ANCESTOR cards; and when he completes one or more stepped groups, each with all the same name, he draws one extra ANCESTOR card for each group, but limited to a maximum of three ANCESTOR cards, e.g., 15 & 30 of the same last name, two ANCESTOR cards; 3, 6, 12, & 24 of the same last name, three ANCESTOR cards.

Short GAME VARIATIONS — THREE PLAYERS

A time limit is set and at the end of the predetermined time period, count one point for each ANCESTOR card on the chart, and an extra point for each ANCESTOR card of the same last name. The player having the most points is the winner.

To further expedite the play at the start of the game, each player may draw eight ANCESTOR cards, four female and four male cards. Also during play, each player "draws", "takes", or "receives" twice the usual amount of ANCESTOR cards indicated by the particular play, while he continues to "give" or "return" only the usual designated number.

A third variation would be a combination of the preceding two paragraphs.

Accordingly, it is apparent from the foregoing that a uniquely novel game and teaching aid has been evolved which achieves all of the objectives and advantages set forth herein above. Also, while the game of ANCESTRY was designed for entertainment purposes, it includes several activities and "trials and tribulations" found in actual "ancestry" research, home, church, library, etc. plus the basic factors of geneology, i.e., time and place. As in real life, success in completing the family tree charts depends on a combination of luck, skill, and logic. It is thought that the game of ANCESTRY will stimulate the desire of the players to trace their own genealogies which is a most rewarding undertaking. Through genealogy, one discovers the part his or her ancestors played in history, thereby gaining pride in family and country, as well as learning to better appreciate and understand his particular country's way of life.

After learning the game of ANCESTRY a player using an unslotted chart or family tree similar to the one used in play, should as a result of some hard work, determination, and some luck be able to trace his own family back at least a couple of hundred years (1770's). He should start with himself as No. 1 on the chart and work backwards from known to the unknown, using the basic factors of time and place. By concentrating on full names, dates and places of birth, marriage, and death, as applicable, he lists on the chart all statistical data that he and his relatives know about himself, his parents, grandparents, etc.; then in reverse order he searches out the certificates of death, marriage, and birth of those ancestors on whom he lacks information.

While the form of the invention herein described constitutes a preferred embodiment of the invention, it is to be understood that it is not limited to the precise form hereof, and that various changes and alterations may be made therein without departing from the scope of the invention as defined in the annexed claims.

Some changes which readily suggest themselves are (1) the playing course need not necessarily be fully peripheral of the board; (2) in lieu of chart line slots, actual pockets may be provided; (3) where slots are used, the color coding strip for the slot may bridge the slot, so that, if desired, the Ancestor cards can have the surname data on the lower half and the cards can be inserted from below rather than above the slot line; and (4) the board may be of other than rectangular shape.

What is claimed is:

1. Game apparatus for playing a game relating to and for educating players about genealogy, comprising in combination:

a. a playing board including an endless playing course having a plurality of serially connected playing spaces provided with indicia means for identifying respective spaces adapted to affect game play according to the indicia thereof; certain of said spaces having indicia means for identifying them generally as male and female ancestor spaces respectively;

b. a plurality of playing pieces for traversing said playing course by each player;

c. chance means operable by players in sequence for determining the number of spaces to be traversed per turn by a playing piece;

d. a genealogy type chart for each player, said charts each having horizontal parallel line indicia commencing at one side and disposed in a generally conventional ascending and descending step fashion, of which predetermined horizontal lines, subsequent to an initial single horizontal line at said one side, are vertically aligned to constitute a plurality of laterally adjacent successively preceding generation-recording means;

e. "Ancestor" card means including a deck of female ancestor cards and a deck of male ancestor cards, respectively bearing on one face thereof the name and other statistical indicia of female and male ancestors dating back over several hypothetical generations; said "Ancestor" cards adapted to be drawn during game play when a playing piece lands upon one of said ancestor spaces; and f. said "Ancestor" cards and said parallel line indicia of said genealogy chart having correlative indicia means for correlating said "Ancestor" cards and said parallel lines to thereby record on said chart ancestors of each given generation in a predetermined manner.

2. The game apparatus of claim 1, wherein certain other of said playing course spaces include indicia means for indentifying them as GRANDMOTHER'S ATTIC spaces; and said game apparatus further including a deck of cards having the indicia GRANDMOTHER'S ATTIC and also bearing different instructions which include among others instructions affecting disposition of said "Ancestor" cards, and instructions affecting further playing piece traversal of said playing course.

3. the game apparatus of claim 2, further including for each of said decks of cards a dual section card tray.

4. The game apparatus of claim 1, wherein said playing board is of four cornered generally rectangular form, and said playing course is peripherally disposed and includes spaces at said four corners bearing indicia which constitute four different combined starting points and ancestral family designations for the respective player's playing pieces, and from which play of playing pieces may be initiated.

5. The game apparatus of claim 4, wherein each side of said game board has at least one of each of said male and female ancestor spaces.

6. The game apparatus of claim 5, wherein certain other course spaces are embellished with legend and pictorial indicia respectively which connote real life genealogy research facilities and institutions; said latter-mentioned spaces constituting resting places not requiring any further play by the player whose piece lands thereon by chance.

7. The game apparatus of claim 1, wherein certain other of said playing course spaces include word indicia means directing further traversal of the playing course responsive to landing thereon by chance.

8. The game apparatus of claim 1, wherein certain other course spaces are embellished with legend and pictorial design indicia which connote real life geneology research facilities and institutions; and latter spaces constituting resting places not necessarily requiring any further play by the player.

9. The game apparatus of claim 1 wherein the playing board embodies multiple sides, and successive spaces of said playing course bear different indicia related to affecting game play, certain space indicia being duplicative along certain sides of the playing board.

10. The game apparatus of claim 1, wherein said genealogy chart horizontal lines are slotted, and said "Ancestor" cards each being of a size to facilitate at least part thereof being placed within a slot in a manner so that at least the name indicia thereof is visible to the players.

11. The game apparatus of claim 1, wherein said correlative indicia means of paragraph (f) include corresponding number and color indicia on said "Ancestor" cards and the chart lines with which they may be played.

12. The game apparatus of claim 1, wherein said genealogy chart has a plurality of five laterally adjacent generation-recording means; said lines commencing with said initial single horizontal line at one side being numbered from 1 through 31; said deck of "Ancestor" cards including plural series of different family name cards extending over several generations, and at least certain of said series of family name cards on their statistics bearing face also including numbers from 1 through 31 for correlation with said chart numbered lines.

13. The game apparatus of claim 1, wherein said genealogy chart has chart-dividing indicia means for horizontally dividing said chart into respectively upper and lower half portions for respectively representing paternal and maternal ancestors of the ancestor to be denoted on said initial single horizontal line of said chart of paragraph (d);

said initial horizontal chart line being of limited linear extent and essentially coextensive with a portion of said chart-dividing indicia means, said initial horizontal chart line constituting depository means for receiving the ancestor card representative of a chronologically most-current generation;

said upper and lower chart half portions respectively having a series of plural ascending horizonal lines, the lines of each respective series having common color coding means to thereby distinguish each of said series from one another; and said statistics bearing faces of predetermined ones of said "Ancestor" cards also being similarly color coded to facilitate mutual correlation thereof.

14. A combination recreational and teaching aid card and board game relating to and for educating players about genealogy, utilizing chance controlled, movable playing pieces and card means including a deck of ancestor-data cards, said game comprising in combination:

a. a playing board having a playing course comprised of a series of playing-piece-traversing spaces some of which are provided with male and female design indicia;

b. a genealogy chart having numbered line indicia disposed in step fashion connecting areas on said chart for identifying successively retrogressing generations and having certain added indicia related to said lines adapted to be correlated to said ancestor-data cards;

c. said deck of ancestor-data cards including cards having design indicia connecting certain of said cards as being female ancestor cards, and other cards as being male ancestor cards, said cards adapted to be separated into two sub decks of male and female cards; and d. said ancestor-data cards also having thereon statistical data including an ancestor name and other indicia adapted for correlating said cards in physical association with said genealogy chart lines in predetermined successive generation form.

15. A game as defined in claim 14 wherein said design indicia of said ancestor-data cards includes on one face of some said cards a silhouette of an early American vintage male for the male ancestor cards, and an early American vintage female for the female ancestor cards.

16. A game as defined in claim 14 wherein each of said sub decks include several series of cards respectively having indicia to designate as many as 28 different principal or surnames thereon.

17. A game as defined in claim 14 wherein said certain added indicia on said genealogy chart, and said other indicia on said ancestor-data cards, respectively include a common series of different color indicia means for correlating certain of said cards with certain of said lines on said genealogy chart.

18. A game as defined in claim 17, further including predetermined number indicia in association with both said genealogy chart lines and with said ancestor-data cards for helping in the correlation of certain of said cards with certain of said lines on said genealogy chart.

19. A game as defined in claim 14 further including a plurality of different playing pieces, and chance-controlled means for establishing the amount of movement of said playing pieces over said playing course;

a plurality of different type cards constituting a deck of play-affecting cards each bearing on one face thereof design indicia depicting an old-time attic scene including an old attic trunk, and further including on an opposite face thereof play-affecting instruction indicia; said cards adapted to be placed in a pile with the attic scene face up during initial game play;

said game board also further including a plurality of spaced-apart spaces which have design indicia corresponding to the attic scene design indicia of said different type cards; with said common attic scene indicia serving to corrolate said attic-scene-bearing cards to said playing board; and whereby said attic-scene-bearing cards are adapted to be drawn and the game affecting instruction indicia on the opposite face thereof followed responsive to a playing piece landing upon any such space which bears the attic scene.

20. The game of claim 19, wherein said attic scene bearing cards and said corresponding attic scene bearing playing board spaces respectively include word indicia of "Grandmother's Attic" thereon to help correlate the cards and the playing board.

* * * * *